United States Patent [19]

Mathers

[11] 4,317,298

[45] Mar. 2, 1982

[54] ICE SCRAPER

[76] Inventor: Harry Mathers, P.O. Box 1351, Exeter, Ontario, Canada, N0M 1S0

[21] Appl. No.: 229,892

[22] Filed: Jan. 30, 1981

Related U.S. Application Data

[63] Continuation of Ser. No. 937,451, Aug. 28, 1978, abandoned.

[30] Foreign Application Priority Data

Aug. 4, 1978 [CA] Canada ..... 308776

[51] Int. Cl.[3] ..... E01H 5/00

[52] U.S. Cl. ..... 37/41; 37/53

[58] Field of Search ..... 37/41, 42 R, 42 VL, 37/50, 53, 141 R, 130; 83/915.3; 299/24; 172/777-792, 810, 811; 15/93 R, 236 R, 256.5, 111; 30/136

[56] References Cited

U.S. PATENT DOCUMENTS

| | | | |
|---|---|---|---|
| 148,816 | 3/1874 | Fisher | 172/781 |
| 1,106,951 | 8/1914 | Langer | 172/788 |
| 1,600,336 | 9/1926 | Jarmin | 172/792 |
| 3,107,446 | 10/1963 | Messinger | 37/130 |
| 4,014,116 | 3/1977 | Baechler | 37/51 X |

FOREIGN PATENT DOCUMENTS

| | | | |
|---|---|---|---|
| 167806 | 4/1954 | Australia | 172/777 |

OTHER PUBLICATIONS

"Principles of Metallographic Laboratory Practice" Kehl, McGraw-Hill, 3rd ed., 1949, pp. 229-242.

"Elements of Material Science" van Vlack, Addison-Wesley Publishing Co., 1960, pp. 460-461.

"Engineering Reference Manual" General Motors Institute, Product Engineering Dept., 1961, Section 2, p. F-17.

*Primary Examiner*—E. H. Eickholt

*Attorney, Agent, or Firm*—Beveridge, DeGrandi & Kline

[57] ABSTRACT

A scraper device, which is powered into forward travel or motion by a tractor that pushes a scraper blade of the device in advance of the tractor, allows the cutting blade to be inclined in the vertical relative to the travelling surface of the ice, on which the device travels. The blade is adjusted into a predetermined inclination of between 8 and 10 degrees relative to the horizontal of the ice surface, while also being adjustable in angle, relative to the line or path of scraping travel at 90° (or orthoginal thereto) or to 15° either side of the line or path of travel as disclosed. Such a device is particularly useful in scraping a rough or pebbled surface of a sheet of ice as is common in curling rink sheets whereby the sheet of ice may thereafter be reconditioned (sprayed with water so as to be pebbled) according to methods commonly known.

4 Claims, 12 Drawing Figures

ICE SCRAPER

This application is a continuation of application Ser. No. 937,451, filed Aug. 28, 1978, now abandoned.

This invention relates to an ice scraper and particularly one suitable for curling rinks or similar ice sheets.

Those familiar with the game of curling will know, it is played on a sheet of ice which has impregnated upon its surface small ice bumps, commonly known as "pebbles".

These pebbles are imposed on the ice sheet by means of a fine spray of water which, when it strikes the ice surface, bonds thereto as it congeals into an ice pebble. The sheet of pebbles is the ideal surface over which the game of curling is played. The "rocks" are pitched from end to end.

After time, the sheet must be resurfaced, that is, the ice pebbles must be removed so as to achieve a smooth flat ice sheet and this also removes all dirt and foreign substances which may have been accumulated and bonded into the surface during curling play. On this cleaned, flat ice sheet a water spray mist is applied to again recreate the bonded pebbles. The surface is restored to the ideal pebble surface for curling play.

Scrapping of the ice sheet in preparation for pebbling has heretofore been done by hand. Sharp blade knives, about 0.5 to 1.3 meters in length, are held in a frame with a long handle much like a push broom. A person pushes the blade by the handle at appropriate angles with the surface; inclining the blade, in the vertical relative to the surface, and angling the blade, relative to the line of scrapping travel. Care and experience is necessary in scraping as to much pressure on the knife blade, or its inappropriate inclination or angle causes ice gouging (at the corners of the blade). This then subsequently requires special repair of the gouged ice regions prior to pebbling; alternatively, if not enough pressure is applied several passes are necessary in order to get the surface depebbled (and cleaned) sufficiently so as to permit appropriate pebbling.

Further, there is no consistency in the scraping result among persons who perform the scraping function. This is enhanced by inexperience of scraper persons and the lack of precision in scraping equipment. Hence it is mandatory that the same scraper-man scrape his own sheet of ice so that all passes are reasonably consistent. Pebbling can then take place. The need for consistency is costly in time and personal resources particularly if 8 to 10 sheets of ice are to be treated (as is common in a Bon Spiel). Hence many scraper men must be employed, simultaneously; needless to say, each of them must as well have had experience.

I have devised a scraper device which is powered by a tractor that pushes the scraper in advance of the tractor, and allows a scraper blade of the scraper to be inclined in the vertical relative to the surface into a preferred predetermined inclination of between 8° to 10° relative to the horizontal, and adjustable in angle, relative to the line of travel of the scraper, orthoginal thereto or at 15° either side of the line or path of travel of the scraper. These features allow a single person to scrape a single or a number of sheets of ice simply, consistently, and without undue effort within a reasonable period of time.

Another feature of my invention, allows variation in the weight or pressure on the scraping blade when it is engaged against the ice surface; the pressure on the blade against the surface may be adjusted by simple means of dead weights which are attached to the scraper blade. This allows adjustment of the blade scraper or cutting pressure. This is important, since different pressures are necessary for different ice conditions; as for example, when the ice is very hard (cold) or less hard (warmer); or, when it has larger or smaller pebbles; each requires different blade pressure to achieve appropriate scraping. If the appropriate pressure is not applied the blade "skips over" the pebbles and this condition is known as "blade chatter". If, on the other hand, excessive blade weight is applied, this causes the blade to dig into the ice surface too much and digs holes into the ice; it then "pops out" during scraping travel leaving an ice "cut" of the length of the blade across the path of scraping travel. "Popping out" may be reasonably avoided by blade angles as disclosed herein. Popping out is to be avoided, as is gouging to be avoided with hand held or operated scrapers.

According to a broad aspect, the invention relates to an ice scraper blade assembly adapted to be propelled over a sheet of ice by driving means for removing surface irregularities from the ice, said assembly comprising:

(a) a frame having a carriage rod for pivotal connection at one end to said driving means, a cross member adjacent to the other end of said carriage rod and normal thereto;

(b) A longitudinal carriage parallel with and pivotally secured to said cross member;

(c) An ice scraping blade having a straight, cutting forward edge secured to said longitudinal carriage;

(d) adjusting means connecting the carriage with said carriage rod for pivoting said carriage and blade to a preferred scraping angle on the ice;

(e) said carriage being adapted to receive weights to increase the pressure of the cutting blade on the ice;

(f) the pivotal connection of the carriage rod to said driving means having its axis intersecting the horizontal axis of the forward wheels of said driving means; and (g) means for selectively setting and maintaining the frame and cutting blade at an angle relative to the path of travel of said driving means.

The invention will now be described by way of example and reference to the accompanying drawings in which.

Figure 1:
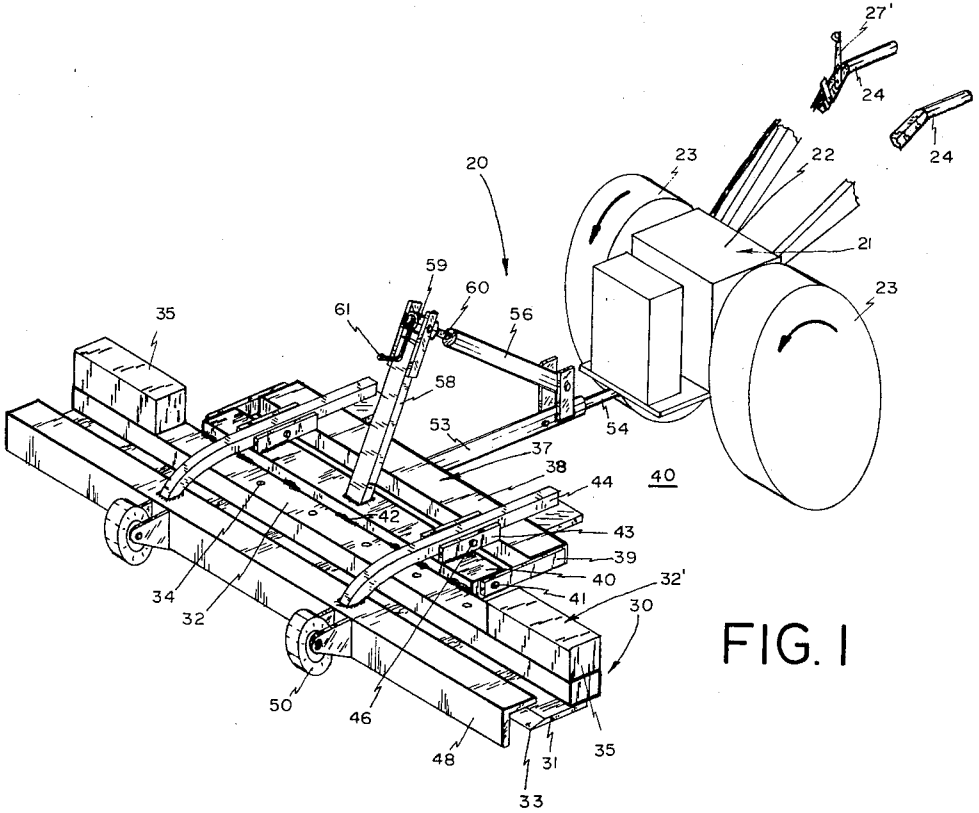
FIG. 1 is a perspective of one embodiment of the invention.

Referring to FIG. 1, an ice scraper 20 is adapted for connection to a tractor 21 with prime mover 22, which preferably is a reversible AC motor, that drives tractor running wheels 23 under operator control via a pair of handle grips 24. The operator (not shown) walks behind the tractor directing it. A cutting blade carriage is generally indicated as 30 is attached to the tractor by a pipe 54, in a manner as will be more clearly explained.

The carriage 30 carries, in a horizontal fashion, an ice cutting blade 31. The blade 31 is attached to a horizontal support member 32 by means, not shown, such as bolts, which extend along and through the rear longitudinal extent of the blade and mate into the horizontal support member 32. Alternatively and preferred, the blade 31 is welded to the horizontal support member 32 so they are an integral unit. In order to achieve precision, along the linear extent of the blade, after welding the unit is stress relieved. Thereafter, the blade is ground on a precision grinding device, sharpened or honed. On the top of the member 32 are spacially disposed apertures 34 which allow for the judicial spacing of a plurality of dead weights 35, with depending fingers that mate into the aperture by which a predetermined factor can be locally applied to various portions of the blade 31 so that its longitudinal cutting edge 33 will engage the ice surface with a determined pressure depending on the existing ice conditions. This aids in the removal of the ice pebbles in a manner as will be explained.

The carriage 30 includes a horizontal frame member 38 with ends 39 projecting forward. Each end defines a pivot point 41. A rocker panel 40 is disposed between the pivot points 41 and is pivotally attached thereto, as by convenient means such as, a bolt and nut arrangement or rivets, which extend through the ends 39 into the rocker panel 40. The forward longitudinal edge of the rocker panel 40 is secured to the horizontal member 32 as by welding (spot wells 42). The rocker panel 40 also carries a pair of U shaped support brackets 43. Into each U shaped support bracket 43 fits an arm 44, which extends forward and attaches to a horizontally positioned frontal shield that also acts as a bumper 48. This bumper 48 extends across the total frontal expanse of the cutting edge 33. Carriage running wheels 50 are attached to the bumper 48 for gliding the carriage 30 over the ice surface 25. The bumper 48 is secured to the carriage 30 with aid of removable bolts 46 that extend through the U shaped supports 43 and the arms 44. In this manner, the blade 31 with its cutting edge 33 is shielded for safety, yet allows removal of the bolts 46 for easy removal of the shield and hence an easy blade replacement procedure.

Figure 7:
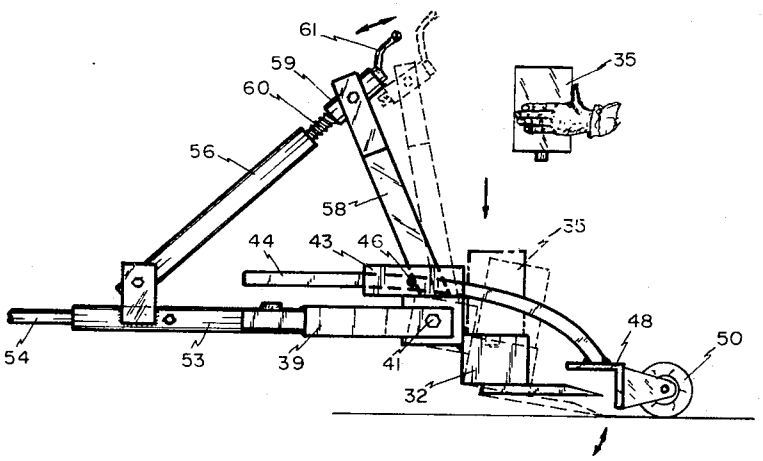
FIG. 7 is a view, in elevation, of that of FIG. 6.
Figure 6:
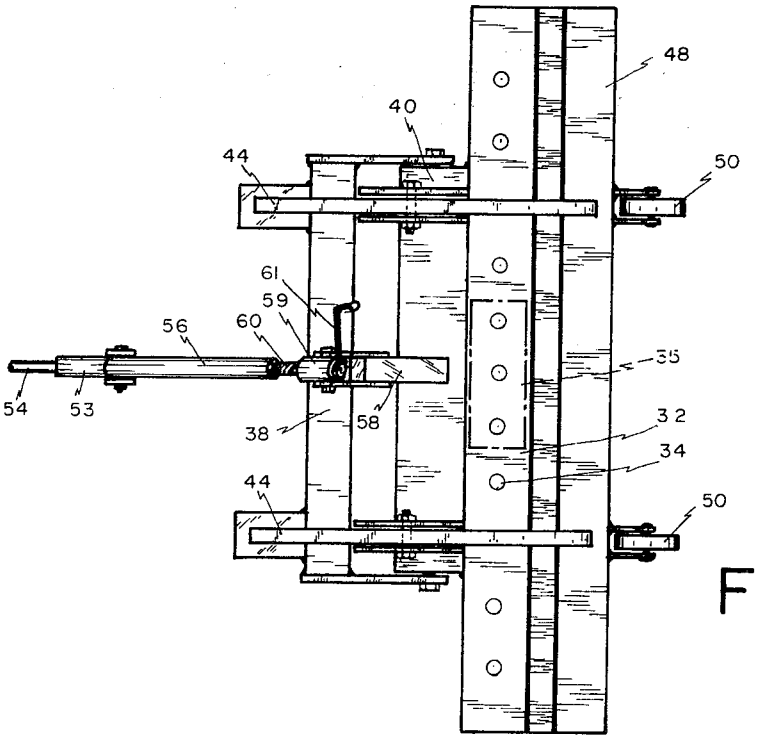
FIG. 6 is a plan view of the blade carrying device (the carriage less tractor).

Accurate blade angle, with the ice, is achieved by an adjustment frame comprising a carriage rod 53 secured at one end to the horizontal frame member 38 and extending rearwardly to mate with the connecting pipe 54. This rod 53 is pivotally attached to a sleeve member 56 defining at its distal end a threaded orifice. From the rocker panel 40 extends, at an inclined angle, a lever bar 58 that defines at its distal end a pivoting bearing block 59. A threaded shaft 60 extends through the bearing block 59 to threadingly mate with the orifice of the sleeve member 56. A crank 61 relatively locates the bearing block 59 and sleeve 56 and thus alters the relative inclination of the blade 31 with the ice surface 25. This is clearly shown, in phantom, in FIG. 7.

Figure 8:
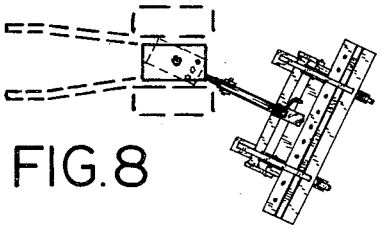
FIGS. 8, 9 and 10 are plan views of the carriage of FIGS. 6 and 7 at the three preferred angulations to the path of scraping travel.
Figure 9:
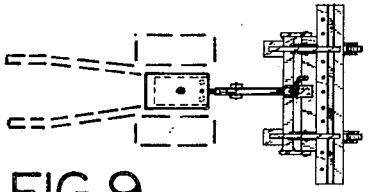
Figure 10:
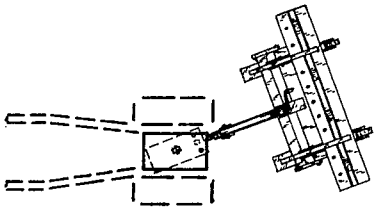

Referring to FIGS. 8, 9 and 10, the carriage 30 and blade 31 may be positioned orthoginal to the line or path of scraping travel, as in FIG. 9, or to either side, thereof, (about 15°) as shown in FIGS. 8 and 10. This is achieved, referring to FIGS. 11 and 12, by the tractor 21 carrying at its bottom a support plate 24' fixedly attached, or integral with the frame of the tractor, and a pivoting plate 25 which pivots about a vertical axis 26 formed by a nut and bolt arrangement (or similiar device) extending through both plates, this axis intersecting the horizontal axis of the tractor driving wheels 23 as seen in FIGS. 8–12. The pivoting plate 25 is attached to the pipe 54 eminating from the carriage 30, as by welding.

Figure 11:
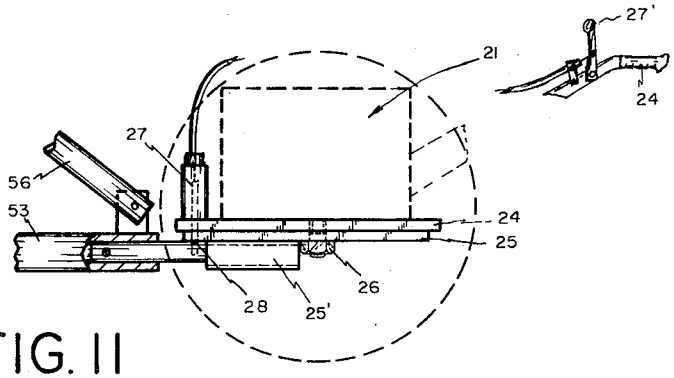
FIG. 11 is an exploded broken away view of the attaching mechanism between tractor and blade carriage.
Figure 12:
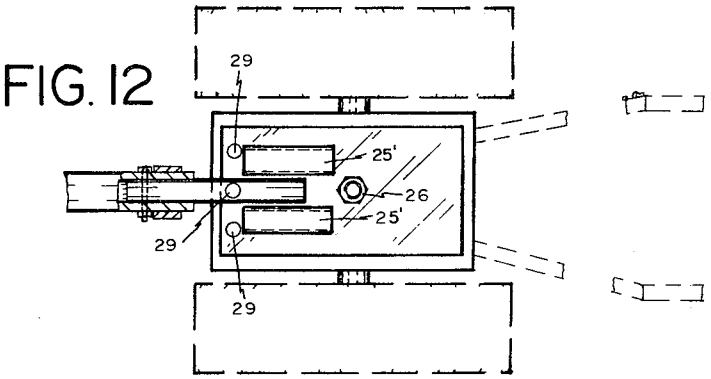
FIG. 12 is a bottom view of FIG. 11.

The pivoting plate 26 has three receiving apertures 29 into which selectively extends a pin 27, which is integral with and controllable by a flexible cable extending back to a control operating lever 27' on one of the handles 24. When the lever 27' is forward, as shown in FIG. 11, the pin 27 extends into one of the receiving apertures 29 and constrains the carriage 30, relative to the tractor 21, in one of the three positions of FIGS. 8, 9 and 10. The relative distance between the apertures 29 is such that the preferred angle to 15° either side of the path of travel can be achieved (FIGS. 8 and 10) or it is fixed in the orthoginal position thereto (90° as in FIG. 9).

Figure 2:
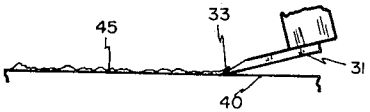
FIGS. 2, 3, 4 and 5 are diagrammatic views, in elevation, showing the sequence of ice treating; namely, the steps of initial (2), partial (3), and complete (4), ice scraping; then the subsequent re-pebbling at (5).
Figure 3:
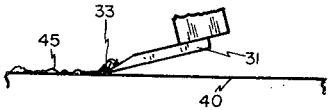
Figure 4:
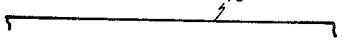
Figure 5:
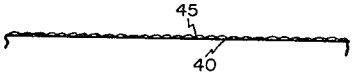

In operation, referring to FIGS. 2 through 5, the prime mover or AC motor 22 is activated and the tractor 21 pushes the carriage 30 forward along the ice surface 25 such that the blade 31 engages the surface 25 and cutting takes place as in FIGS. 2 and 3. It may be necessary, depending upon the conditions of the ice, whether it be hard or soft, that weights 35 be mounted unto the horizontal cross member 32, as shown, or at other locations thereon convenient as accomodated by the plurality of receiving apertures 34 along the upper surface of the cross member 32. The relative inclination of the cutting edge 33 of the blade 31 relative to the ice surface can be adjusted in the preferred range of 8° to 10° (relative the horizontal ie. the ice surface) by means of the crank 61. The blade 31 is a very sharp blade. Such blade 31 is a modification of a blade commonly as found in the paper industry and known as a "paper knife" blade. It has a ROCKWELL hardness of 65. This blade is commonly found in the pulp and paper industry. This blade has the ideal properties, when integrated with the horizontal support member 32 and mounted in the carriage 30 and operated as above described, for cutting the pebbles, 45, off the surface 25 of the ice as shown in FIGS. 2 and 3.

The embodiments of the invention in which an exclusive property or privilege is claimed are defined as follows:

1. An ice scraper blade assembly adapted to be propelled over a sheet of ice by driving means for removing surface irregularities from the ice, said assembly comprising:

(a) a frame having a linear connector bar for pivotal connection at one end to said driving means, a cross member adjacent to the other end of said connector bar and normal thereto;

(b) a longitudinal carriage parallel with and pivotally secured to said cross member;

(c) an ice scraping blade having a straight, cutting forward edge secured to said longitudinal carriage;

(d) adjusting means connecting the carriage with said connector bar for pivoting said carriage and blade to a preferred scraping angle on the ice;

(e) said carriage being adapted to receive weights to increase the pressure of the cutting blade on the ice;

(f) the pivotal connection of the connector bar to said driving means having its axis intersecting the horizontal axis of the forward wheels of said driving means; and (g) means for selectively setting and maintaining the frame and cutting blade at an angle relative to the path of travel of said driving means.

2. The assembly of claim 1 wherein said selective setting means includes a first plate for securement to the base of said driving means, a second plate in face-to-face relation with said first plate and secured to said frame connector bar, said second plate being pivotally mounted to the first plate by the connector bar pivot; a plurality of apertures in said second plate and a retractable pin mounted on the first plate to selectively engage one of said apertures when the second plate is angularly disposed to said first plate.

3. An ice scraper blade assembly adapted to be propelled over a sheet of ice by driving means for removing surface irregularities from the ice, said assembly comprising:

(a) a frame having a carriage rod for pivotal connection at one end to said driving means, a cross member adjacent to the other end of said carriage rod and normal thereto;

(b) a longitudinal carriage parallel with and pivotally secured to said cross member;

(c) an ice scraping blade having a straight, cutting forward edge secured to said longitudinal carriage;

(d) adjusting means connecting the carriage with said carriage rod for pivoting said carriage and blade to a preferred scraping angle on the ice;

(e) said carriage being adapted to receive weights to increase the pressure of the cutting blade on the ice;

(f) the pivotal connection of the carriage rod to said driving means having its axis intersecting the horizontal axis of the forward wheels of said driving means; and (g) means for selectively setting and maintaining the frame and cutting blade at an angle relative to the path of travel of said driving means.

4. The assembly of claim 3 wherein said selective setting means includes a first plate for securement to the base of said driving means, a second plate in face-to-face relation with said first plate and secured to said carriage rod, said second plate being pivotally mounted to the first plate by the carriage rod pivot; a plurality of apertures in said second plate and a retractable pin mounted on the first plate to selectively engage one of said apertures when the second plate is angularly disposed to said first plate.

* * * * *